US006125247A

United States Patent [19]

Tsukida et al.

[11] Patent Number: 6,125,247

[45] Date of Patent: Sep. 26, 2000

[54] IMAGE FORMING APPARATUS

[75] Inventors: Shinichi Tsukida, Yono; Toshiaki Miyashiro, Shizuoka-ken; Kimitaka Ichinose, Susono, all of Japan

[73] Assignee: Canon Kabushiki Kaisha, Tokyo, Japan

[21] Appl. No.: 09/334,561

[22] Filed: Jun. 21, 1999

[30] Foreign Application Priority Data

Jun. 19, 1998 [JP] Japan ..... 10-172932
Jun. 8, 1999 [JP] Japan ..... 11-160914

[51] Int. Cl.[7] ..... G03G 15/16

[52] U.S. Cl. ..... 399/66

[58] Field of Search ..... 399/302, 308, 399/66

[56] References Cited

U.S. PATENT DOCUMENTS

| | | | |
|---|---|---|---|
| 5,214,480 | 5/1993 | Aoki et al. | 355/274 |
| 5,264,902 | 11/1993 | Suwa et al. | 355/282 |
| 5,390,012 | 2/1995 | Miyashiro et al. | 355/273 |
| 5,508,796 | 4/1996 | Sasame et al. | 355/271 |
| 5,523,829 | 6/1996 | Miyashiro et al. | 355/271 |
| 5,539,507 | 7/1996 | Miyashiro et al. | 355/271 |
| 5,809,373 | 9/1998 | Yoda et al. | 399/101 |
| 5,899,610 | 5/1999 | Enomoto et al. | 399/302 |

FOREIGN PATENT DOCUMENTS 7-225520 8/1995 Japan .

*Primary Examiner*—Sandra Brase
*Assistant Examiner*—Greg Moldafsky
*Attorney, Agent, or Firm*—Fitzpatrick, Cella, Harper & Scinto

[57] ABSTRACT

An image forming apparatus includes a movable image bearing member for bearing different color toner images; a movable intermediary transfer member including an electroconductive layer and a surface layer; first transferring means for applying a voltage to the electroconductive layer to sequentially and superimposedly transfer the different color toner images from the image bearing member onto the intermediary transfer member at a first transfer position; second transferring means for electrostatically transferring the different color toner images from the intermediary transfer member on the transfer material at a second transfer position, wherein the second transferring means is disposed faced to such a side of the intermediary transfer member as receives the toner image; wherein the image forming apparatus is operable with the transfer material having a length measured in a direction of feeding of the transfer material, which is longer than a distance between the first transfer position to the second transfer position in a moving direction of the intermediary transfer member; wherein when a toner image is formed on the transfer material having a length in the transfer material feeding direction longer than the distance, the different color toner images on the intermediary transfer member pass through the first transfer position in a period which is after completion of transfer of the different color toner image from the image bearing member onto the intermediary transfer member by the first transferring means and before transfer of the different color toner images from the intermediary transfer member onto the transfer material by the second transferring means; control means for switching a voltage applied to the electroconductive layer by the first transferring means from a first voltage for transferring a final color toner image from the image bearing member onto the intermediary transfer member to a second voltage having a smaller absolute value than that of the first voltage before a leading edge of the different color toner images on the intermediary transfer member reaches the first transfer position; wherein the second transferring means starts transfer of the toner image from the intermediary transfer member onto the transfer material after the control means switches the voltage to the second voltage.

45 Claims, 7 Drawing Sheets

$$SF1 = \frac{(MXLNG)^2}{AREA} \times \frac{\pi}{4} \times 100$$

$$SF2 = \frac{(PERI)^2}{AREA} \times \frac{1}{4\pi} \times 100$$

IMAGE FORMING APPARATUS

FIELD OF THE INVENTION AND RELATED ART

The present invention relates to an image forming apparatus employing an electrophotographic system, an electrostatic recording system, or the like. In particular, it relates to an image forming apparatus comprising an intermediary transfer member, in addition to those systems mentioned above.

As an image forming apparatus capable of forming an image with no color aberration, an image forming apparatus with an intermediary transfer member has been proposed. FIG. 10 illustrates the general structure of such an image forming apparatus. A photosensitive drum 101 which is being driven in the direction indicated by an arrow mark is first uniformly charged on its peripheral surface by a charge roller 102. Next, the charged surface is exposed to a laser beam 103, which is moved in a manner to scan the peripheral surface of the photosensitive drum 101 while being turned on or off on the basis of image formation data. As a result an electrostatic latent image is formed on the photosensitive drum 101. This electrostatic latent image is developed (visualized) by a developing apparatus 104 in which a plurality of developing devices 104*a*, 104*b*, 104*c*, and 104*d* are rotatively disposed so that their position can be switched. Each of these developing devices comprises a development sleeve. Black toner as the toner of the first color is contained in the first development device 104*a*; magenta color toner as the toner of the second color, in the second developing device 104*b*; cyan color toner as the toner of the third color, in the third developing device 104*c*, and yellow color toner as the toner of the fourth color is contained in the fourth developing device 104*d*. The aforementioned electrostatic latent image is developed (visualized) by the first developing device 104*a* containing black toner as the first toner. The normal polarity of the toner is negative. The first toner image, that is, the image created by developing the electrostatic latent image with the use of the first toner, is electrostatically transferred (primary transfer), at the first transfer point 106*a*, by a primary transfer roller 109 and a power source 110, onto the surface of an intermediary transfer belt 105 which is being rotatively driven in the direction indicated by an arrow mark, with the surface of the intermediary transfer belt 105 squarely facing the peripheral surface of the photosensitive drum 101. After the primary transfer, a small amount of the first transfer residual toner, that is, the toner remaining on the peripheral surface of the photosensitive drum 101 after the first transfer, is removed by a cleaning apparatus 107.

Next, the above described process is repeated three more times. As a result, toner images are transferred in layers onto the surface of the intermediary transfer belt 105. More specifically, the second toner image created by developing an electrostatic image by the magenta toner, the third toner image created by developing an electrostatic latent image by the cyan toner, the fourth toner image created by developing an electrostatic latent image by the yellow toner, are consecutively transferred in layers onto the surface of the intermediary transfer belt 105.

Thereafter, a transfer roller 108 for the secondary transfer, which is kept separated from the surface of the intermediary transfer belt 105 when not in action, is placed in contact with the surface of the intermediary transfer belt 105, and is rotatively driven. The interface between the photosensitive drum 101 and the transfer roller 108 for the secondary transfer forms a secondary transfer point (station) 106*b*, at which the toner images on the surface of the intermediary transfer belt 105 are transferred (secondary transfer) all at once by the transfer roller 8 for the secondary transfer and a power source 111, onto the surface of a piece of transfer medium P conveyed to the second transfer point 106*b* with predetermined timing.

During this transfer process, the leading edge of the toner image having been transferred onto the intermediary transfer belt 105 reaches the second transfer point, and begins to be transferred (secondary transfer) onto a piece of recording medium while the trailing end portion of the toner image is still borne on the photosensitive drum 101, that is, it has not been transferred (primary transfer) onto the intermediary transfer belt 105; the primary and secondary transfer processes concurrently progress.

In other words, when an image is formed on a sheet of paper of a certain size, the peripheral distance from the first transfer point 106*a* to the second transfer point 106*b* along the surface of the intermediary transfer belt 105, in the rotational direction of the intermediary transfer belt 105, is shorter than the overall length of a toner image to be formed.

After the transfer, the recording medium P is conveyed to an unillustrated fixing apparatus, in which the toner image is fixed into a permanent image. Then, the recording medium P is discharged from the image forming apparatus.

Japanese Laid-Open Patent Application No. 225,520/1995 discloses an image forming process, according to which, when it is necessary to form a full-color image on a large piece of recording medium, the intermediary transfer belt is idled one full rotation, instead of transferring (primary transfer) the toner image of the second toner onto the recording medium immediately after the toner image of the first color is transferred (primary transfer) onto the surface of the intermediary transfer belt, so that during this idling period, the developing device for the first color is switched with the developing device for the second color. Then, the toner image of the second color is transferred onto the surface of the intermediary transfer belt. In other words, the intermediary transfer belt is rotated seven times overall to finish transferring a full-color image onto the recording medium.

While the intermediary transfer belt 105 is idled one full turn after the completion of the primary transfer of the toner image of, for example, the fourth color, but prior to the starting of the secondary transfer of the toner image of the fourth color, the toner image having been transferred (primary transfer) onto the intermediary transfer belt 105, passes through the first transfer point. During this period, in order to prevent the toner image on the intermediary transfer belt 105 from being off-set onto the photosensitive drum 101, bias must be applied to a transfer roller 109 for the primary transfer. Further, the application of this bias must be continued from the time when the leading end of the toner image passes the transfer roller 109 for the first transfer, to the time when the trailing end of the toner image passes the transfer roller 109 for the primary transfer, in order to prevent the toner image from being disturbed by the fluctuation of electrical charge. However, such a practice creates a situation in which the application of the bias for the secondary transfer must be begun while the aforementioned bias is being applied. In this situation, if the potential level of the bias to be applied to the transfer roller 109 for the primary transfer is high, the potential level of the bias to be applied to the transfer roller 108 for the secondary transfer must be substantially increased in proportion to the bias to be applied to the transfer roller 109 for the first transfer. This create various problems in terms of overall size and cost of an image forming apparatus. For example, the power source 111 must be increased in capacity, and the peripheral length of the intermediary transfer belt has to be increased (distance between the first and second transfer points 106*a* and 106*b* has to be increased). In other words, the cost and size of an image forming apparatus increases.

SUMMARY OF THE INVENTION

The primary object of the present invention is to prevent the formation of a low quality image without requiring increase in image formation apparatus size, so that an image forming apparatus of a smaller size can be provided.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Embodiment 1

Figure 1:
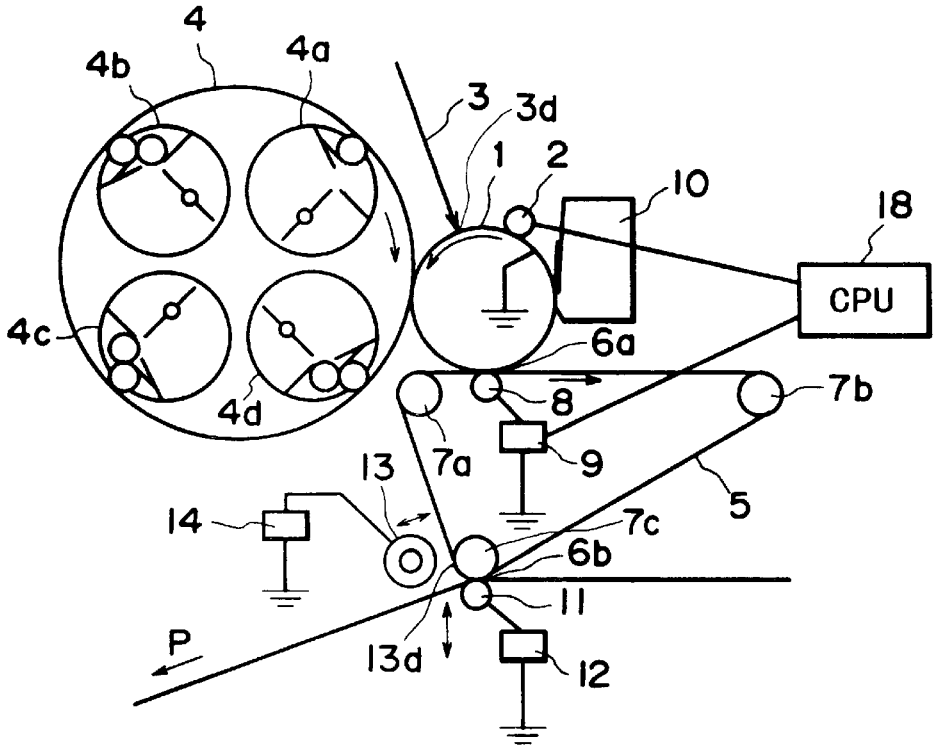
FIG. 1 is a schematic sectional view of a full-color image forming apparatus to which the present invention is applicable.

FIG. 1 is a schematic sectional view of a full-color image forming apparatus compatible with the present invention.

In FIG. 1, a referential character 1 designates a photosensitive drum, which comprises a cylindrical base member formed of aluminum or the like material, and a layer of photosensitive material, for example, an organic photoconductor, coated on the peripheral surface of the base member. The photosensitive drum 1 is rotatively driven in the direction indicated by an arrow mark at a peripheral velocity of 120 mm/sec. First, its peripheral surface is uniformly charged by a charge roller 2 as a charging apparatus, to a potential level of approximately −700 V (dark portion potential level $V_D$). Then, the charged peripheral surface is scanned at an exposure point 3*a*, by a laser beam 3, which is turned on and off in response to the first image formation data. As a result, a first electrostatic latent image is formed on the peripheral surface of the photosensitive drum 1. The potential level of a light area of the electrostatic latent image is approximately −100 V. The electrostatic latent image formed in the above described manner is developed into a visual image by a developing apparatus 4. The developing apparatus 4 integrally comprises: a first developing device 4*a* which contains toner of black color as the first toner; a second developing device 4*b* which contains toner of magenta color as the second color; a third developing device 4*c* which contains toner of cyan color as the third color; a fourth developing device 4*d* which contains toner of yellow color as the fourth color. It also comprises a rotary moving means which makes it possible for each of these developing devices to be rotated to a development station to be switched with the one in the development station, in 1,200 milliseconds. The normal polarity to which the black, magenta, cyan, and yellow toners are charged is negative. The aforementioned first electrostatic latent image is developed into a visible image by the first developing device 4*a* in which black toner as the first toner is contained. As for the developing method, a jumping development method is used in combination with a reversal development process.

The black toner image, a visual image, is electrostatically transferred at the first transfer point 6*b*, onto an intermediary transfer belt 5 as an intermediary transfer member, which is being rotatively driven in the direction of an arrow mark, by applying a predetermined voltage (positive) from a high voltage power source 9 to a transfer roller 8 or primary transfer, which is disposed at the first transfer point 6*a* in a manner to squarely face the intermediary transfer belt 5. The intermediary transfer belt 5 is constituted of an approximately 0.3–2 mm thick elastic base layer as an electrically conductive layer, and a 2–100 $\mu$m thick surface layer. The base layer is formed of urethane rubber, hydrin rubber, NBR (nitrile butadiene rubber), EPDM (copolymer of ethylene, propylene, and diene), or the like, which has a volumetric resistivity of $10^4$–$10^8$ Ω·cm, and the surface layer is formed of resin, for example, PVdF (polyvinylidene fluoride), PET (polyethyleneterephthalate), polycarbonate, polyethylene, silicon, and the like, which has a volumetric resistivity of $10^{10}$–$10^{14}$ Ω·cm. In order to prevent toner particles from being scattered from the toner image on the intermediary transfer belt, the volumetric resistivity of the resin layer is desired to be $10^{10}$–$10^{14}$ Ω·cm. The intermediary transfer belt 5 has a peripheral length of 441 mm, and is supported by supporting rollers 7*a*, 7*b*, and 7*c* (metallic rollers). It is placed in contact with the peripheral surface of the photosensitive drum 1 by the transfer roller 8 for primary transfer, with the application of a predetermined contact pressure, and is rotatively driven in the rotational direction of the photosensitive drum 1 at substantially the same peripheral velocity as that of the photosensitive drum 1. As a voltage (primary transfer bias) which has the opposite polarity to the normal charge polarity of the toner is applied to the transfer roller 8 for primary transfer from a high voltage power source 8, the toner image formed in the aforementioned manner is electrostatically transferred (primary transfer) onto the surface of the intermediary transfer belt 5.

Since the transfer roller 8 is in contact with the base layer of the intermediary transfer belt 5, at the first transfer point 6*a*, as described above, the potential level of the base layer of the intermediary transfer belt 5 becomes substantially uniform along its entire length. The first transfer residual toner, that is, a small amount of toner which remains on the peripheral surface of the photosensitive drum 1 after the primary transfer, is removed by a cleaning apparatus 10.

The above described process is repeated three more times. As a result, a magenta toner image developed by the magenta toner, a cyan toner image developed by the cyan toner, and a yellow toner image developed by the yellow toner, are consecutively transferred in layers onto the surface of the intermediary transfer belt 5.

Next, a transfer roller 11 for secondary transfer, which has been kept away from the surface of the intermediary transfer belt 5 when not in action, is placed in contact with the surface of the intermediary transfer belt 5, with a predetermined contact pressure which is strong enough to press the intermediary transfer belt 5 against the support roller 7*c*, and begins to be rotatively driven. To the transfer roller 11 for secondary transfer, a voltage (secondary transfer bias) which has the opposite polarity to the normal charge polarity of toner is applied. As a result, the toner images, which have been consecutively transferred in layers onto the surface of the intermediary transfer belt 5 are transferred (secondary transfer) all at once onto the surface of a piece of transfer medium P which is being conveyed past the second transfer point 6*b* with a predetermined timing. Thereafter, the recording medium P is conveyed into an unillustrated fixing apparatus, in which the toner images are permanently fixed to the recording medium P. Finally, the recording medium with fixed toner images is discharged out of the image forming apparatus.

Figure 2:
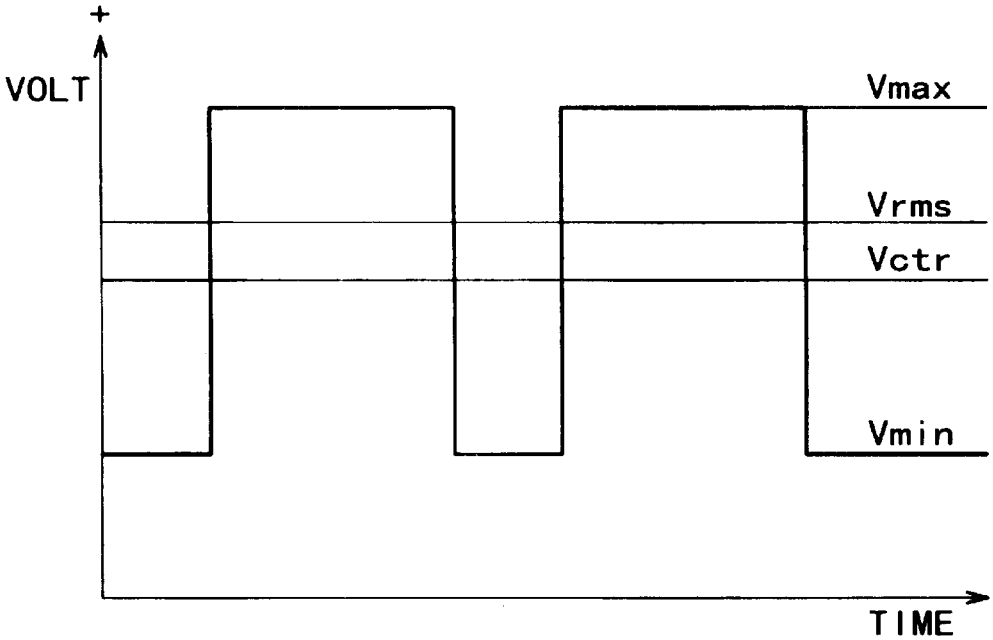
FIG. 2 is a graphic drawing which shows the wave-form of the bias applied to a cleaning roller.

The secondary transfer residual toner, that is, a small amount of the toner which remains on the surface of the intermediary transfer belt 5 after the secondary transfer, is charged by a cleaning roller 13, which is placed in contact with the surface of the intermediary transfer belt 5 with a predetermined timing by an unillustrated driving means. This cleaning roller 13 comprises a metallic core, a 2–6 mm thick elastic layer coated on the metallic core, and a 10–300 $\mu$m thick surface layer coated on the elastic layer. The elastic layer is formed of elastic material such as rubber or sponge, which has a volumetric resistivity of $10^4$–$10^6$ Ω·cm, and the surface layer is formed of rubber, resin, or the like, which has a volumetric resistivity of $10^6$–$10^{12}$ Ω·cm. While the toner images on the peripheral surface of the photosensitive drum 1 are consecutively transferred (primary transfer) onto the surface of the intermediary transfer belt 5, the cleaning roller 13 is kept away from the surface of the intermediary transfer belt 5. Then, after the simultaneous transfer of all the toner images on the intermediary transfer belt 5 onto the surface of the recording medium P, the cleaning roller 13 is pressed against the support roller 7*c*, with the intermediary transfer belt 5 being pinched between them, and bias is applied to the cleaning roller 13 by a high voltage power source 14. It is desired that the bias applied to the cleaning roller 13 is a compound voltage composed of an AC voltage and a DC voltage as illustrated in FIG. 2, in other words, an alternating voltage with a rectangular wave-form. In FIG. 2, a referential character $V_{max}$ represents the maximum voltage value; $V_{min}$: the minimum voltage value; $V_{ctr}$: the average value between the maximum value $V_{max}$ and the minimum value $V_{min}$; and a referential character $V_{rms}$ represents the effective voltage value. The apparatus is configured so that the application of alternating voltage with an asymmetrical wave-form causes the effective voltage value $V_{rms}$ to be different from the average value $V_{ctr}$. With the above configuration, the second transfer residual toner which remains on the surface of the intermediary transfer belt 5 is charged to the opposite polarity (positive) relative to the normal charge polarity of the toner, and is transferred back onto the peripheral surface of the photosensitive drum 1 from the surface of the intermediary transfer belt 5. More specifically, the second transfer residual toner which has resulted from the preceding toner image formation cycle is transferred back onto the peripheral surface of the photosensitive drum 1 at the same time as a toner image, for example, the black toner image developed by the black toner, in the current toner image formation cycle, is transferred (primary transfer) from the peripheral surface of the photosensitive drum 1 onto the surface of the intermediary transfer belt 5. After the reversal transfer, the secondary transfer residual toner, which now is on the peripheral surface of the photosensitive drum 1, is recovered by a cleaning apparatus (blade) for the photosensitive drum 1, which completes the process for cleaning the secondary transfer residual toner which remains on the surface of the intermediary transfer belt 5. When the image forming operation is not continued further, the secondary transfer residual toner on the intermediary transfer belt 5 is transferred back onto the photosensitive drum 1 without carrying out the primary transfer.

Next, the toners in this embodiment will be described.

The black toner in this embodiment is a single component magnetic toner composed of microscopic particles which contain carbon black, magnetite, etc. It is formed by pulverization. Its particle diameter is approximately 4–8 $\mu$m, and it has an electrostatic capacity of −10 $\mu$C/g.

The other toners, that is, the magenta, cyan, and yellow toners, are manufactured with the use of suspension polymerization, for example, and contain a substance with a low softening point by 5–30 (wt. %). They are nonmagnetic single component polymer toner, the shape factors SF1 and SF2 of which are 100–120, and the particle diameters of which are 5–7 $\mu$m. In other words, they are composed of virtually spherical particles.

Figure 3:
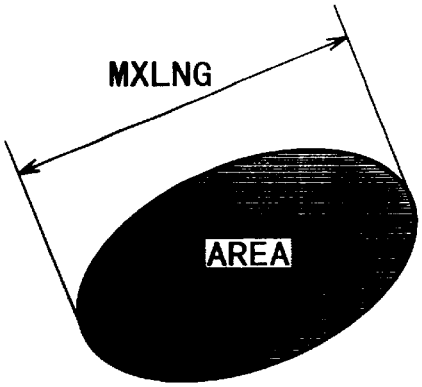
FIG. 3 is a schematic drawing which gives the definition of a shape factor SF1.
Figure 4:
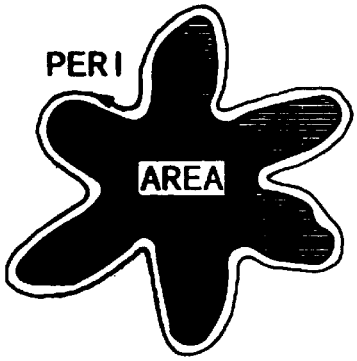
FIG. 4 is a schematic drawing which gives the definition of a shape factor SF2.

The aforementioned shape factor SF1 is such a numerical value that indicates in ratio the degree of the roundness of a spherical object as shown in FIG. 3; it is a value obtained by dividing the square of the maximum cross sectional length MXLNG of the oval shape which results when a spherical object is projected onto a two dimensional plane, by the area AREA of the oval shape, and then, multiplying by 100π/4.

In other words, the shape factors are defined by the formula (4) given below.

$$SF1=\{(MXLNG)^2/AREA\}\times(100\pi/4) \quad (4)$$

The shape factor SF2 is a numerical value which indicates in ratio the degree of the irregularity in the shape of an object; it is a value obtained by dividing the peripheral edge length PERI of the shape which results when an object is projected onto a two dimensional plane, by the area AREA of the projected shape, and then, multiplying by 100/4π.

In other words, it is defined by a formula (5) given below.

$$SR2=\{(PERI)2/AREA\times(100/4\pi) \quad (5)$$

In this embodiment, the shape factors are calculated in the following manner. First, 100 toner images were randomly selected with the use of an FE-SEM (S-800) (Hitachi, Ltd.), and the image data of the samples were fed into an image analysis apparatus (LUSEX3) (Nikon Corp.). Then, the results of the analysis were substituted into the formulas (4) and (5).

Figure 5:
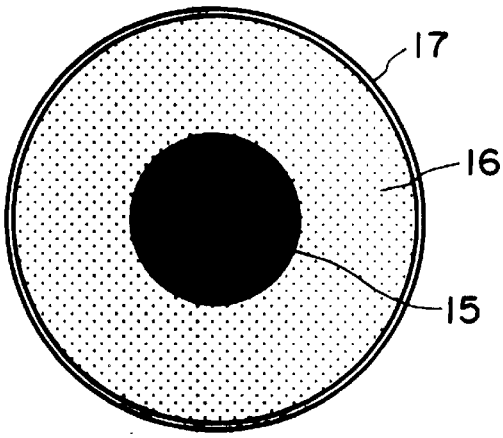
FIG. 5 is a schematic sectional view of a polymer toner particle, and depicts the structure thereof.

The general structure of a particle of the aforementioned polymer toner is illustrated in FIG. 5. The particles of polymer toner become approximately spherical due to the manufacturing method of polymer toner. In this embodiment, polymer toner was composed of particles which comprise a core 15 of ester wax, a resin layer 16 of styrene acrylate, and a surface layer 17 of styrene-polyester, layered in this order from inside. Its specific gravity was 1.05. The provision of the central wax core 15 was effective to prevent the toner particles from off-setting during the fixing process, and the provision of the surface layer 17 of resin could improve the charge efficiency of the toner. Further, the toner in this embodiment was mixed with oil treated silica to stabilize the electrostatic capacity of the toner. The electrostatic capacity of the toner was approximately −40 $\mu$C/g.

In the case of an image forming apparatus in which a plurality of the aforementioned developing devices must be switched in place by the rotary moving means 14 for each development step, the provision of the time t for switching the developing device is necessary for each color, and this time t affects the size of the intermediary transfer belt 5 in the following manner.

That is, the intermediary transfer belt 5 is being rotatively driven at a predetermined velocity even during the developing device switching time t, and therefore, the peripheral length L of the intermediary transfer belt 5 must include the margin V·t for switching the developing devices. Thus, when the maximum length of the printable area of a piece of transfer medium is $L_p$, the following relationship must be satisfied.

$$L-L_P \geqq V \cdot t \quad (1)$$

Provided that the developing device switching time t is 1,200 milliseconds, and recording medium size is A4 (210 mm in width×297 mm in length)/letter size 215.9 mm in width×279.4 in length), in order to form a full-color image at a processing speed V, the intermediary transfer belt 5 must be longer in peripheral length than 441 (mm)=297 (mm)+1,200 (msec)×120 (mm/sec). However, the condition expressed by the formula (1) is such a condition that is required only for forming a full-color image. In other words, when a monochrome image is formed, the formula (1) does not need to be satisfied because the formation of a monochrome image does not require the developing device switching time t. Therefore, the size of a monochrome image can be as large as the peripheral length of the intermediary transfer belt 5 can afford. For example, in the case of an image forming apparatus capable of accommodating a piece of recording medium as wide as 215.9 mm, it can form a monochromatic image as large as the printable surface size of a legal size recording medium (215.9 mm in width×355.6 in length), that is, the longest sheet of recording medium among the cut sheets of known regulation sizes, but cannot form a full-color image as large as a legal size monochrome image, which makes the apparatus odd in terms of specification, and confuses the user. Further, if an attempt is made to solve this problem by employing an intermediary transfer belt which makes it possible to form a full-color image matching the legal size, the image formation apparatus size becomes rather large, which inevitably leads to cost increase.

Thus, in this embodiment, when forming an image on a large piece of recording medium which does not satisfy the formula (1), the default image formation sequence is switched to a sequence for a large size recording medium. More specifically, when forming a full-color image on a large piece of recording medium which does not satisfy the formula (1), the intermediary transfer belt 5 is idled one full turn, that is, rotated without carrying out the primary transfer, immediately after the transfer of the black toner image, the toner image of the first color, onto the intermediary transfer belt 5, so that the developing devices can be switched during this idling period. Then, the magenta toner image, the toner image of the second color, is transferred onto the intermediary transfer belt 5.

Hereinafter, the printing sequences employed by a full-color image forming apparatus in accordance with the present invention will be described in detail.

Figure 6:
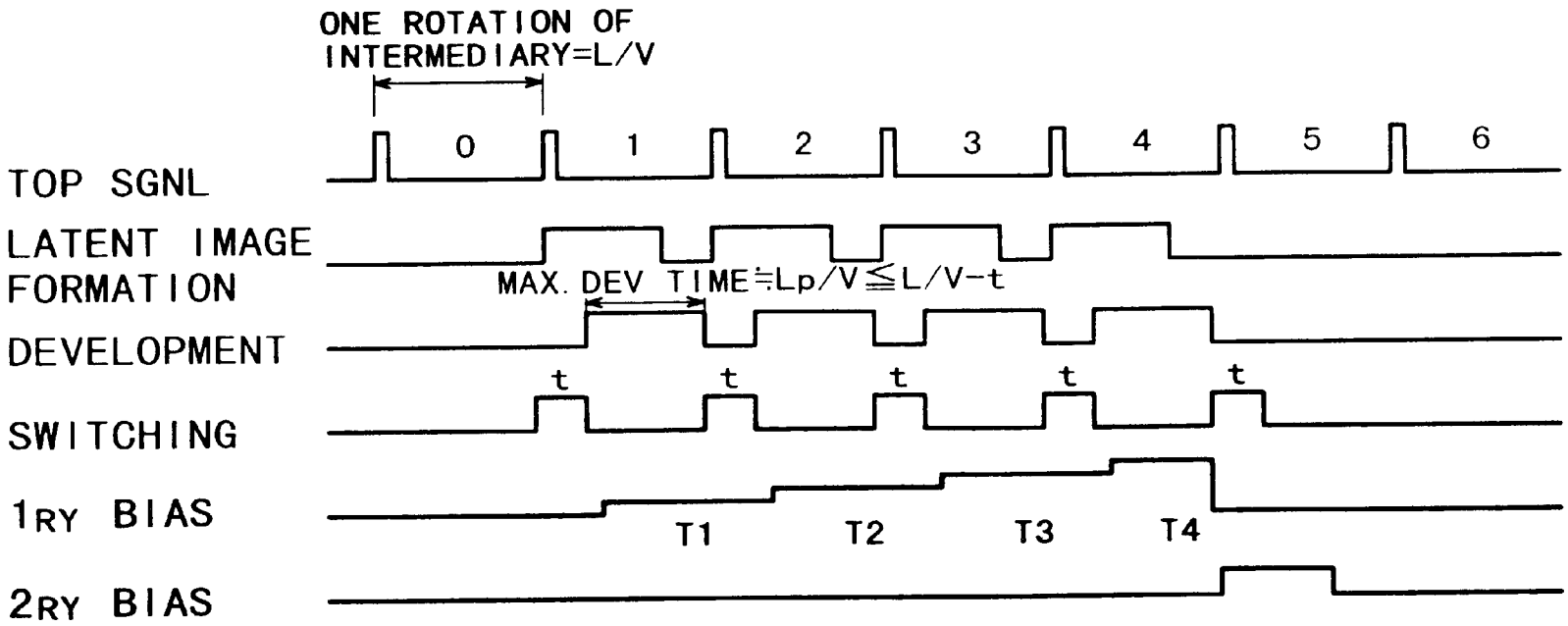
FIG. 6 is a diagram for describing a normal sequence in accordance with the present invention.
Figure 7:
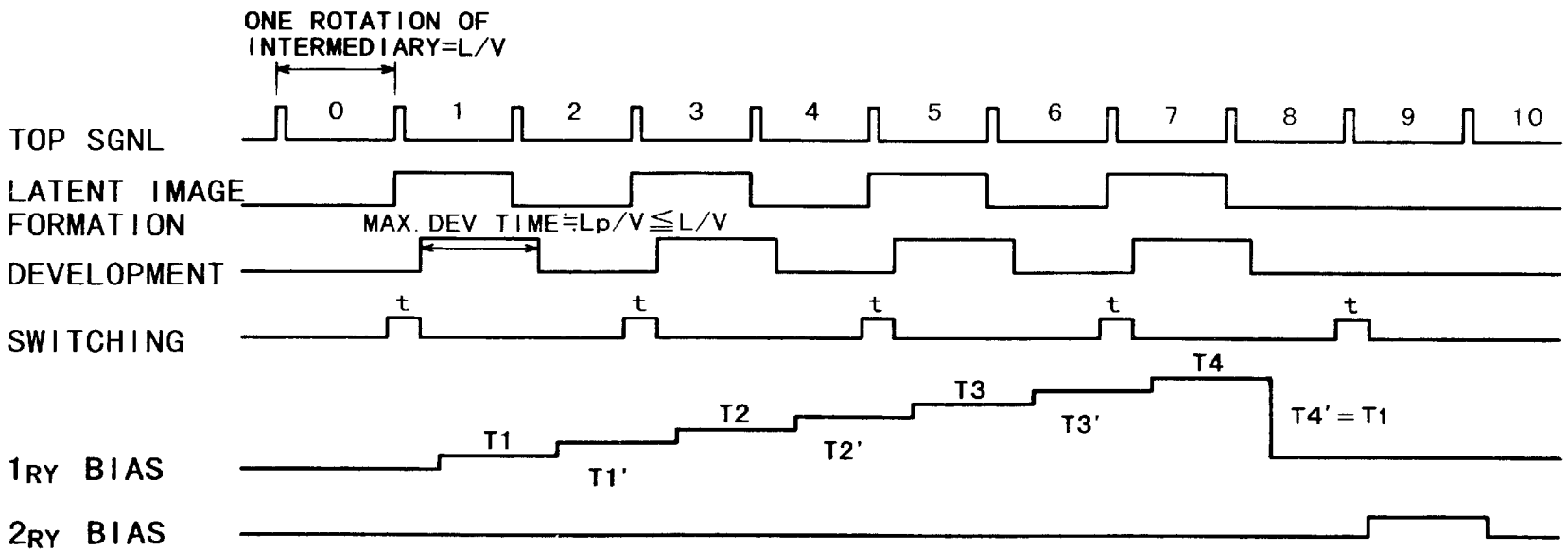
FIG. 7 is a diagram for describing the sequence for a large piece of recording medium.
Figure 8:
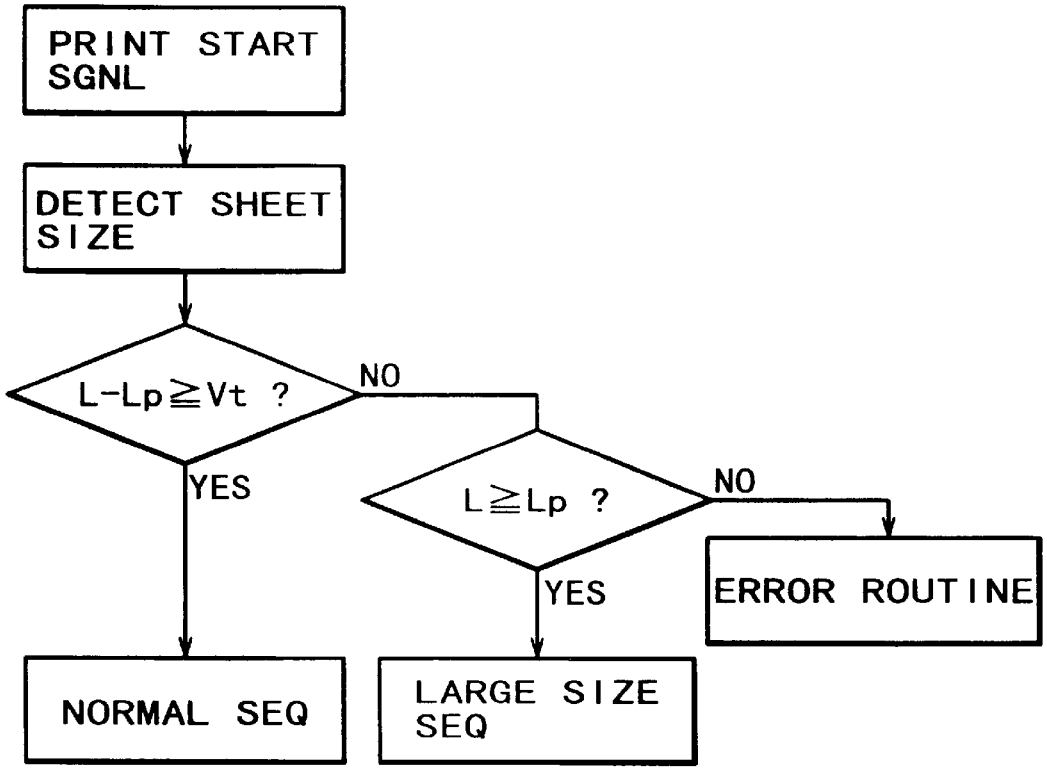
FIG. 8 is a flow chart of a sequence for selecting a pertinent image formation sequence.

First, in this embodiment, the transfer medium size, in particular, the length in the transfer medium conveyance direction, is detected by an unillustrated sheet size detecting means, and the detected length is sent to a controlling apparatus 18, which selects one of two image formation modes (sequences) on the basis of the detected sheet length. More specifically, provided that the peripheral length of the intermediary transfer belt 5 in this embodiment is 441 mm, when forming a full-color image on a sheet of recording medium, as long as the length of the sheet does not exceed the length of an AF size sheet, it satisfies Formula (1). Therefore, it is unnecessary to idle one full turn for each primary. Thus, the normal sequence depicted in FIG. 6 is carried out. When forming a monochrome image (for example, black image), a secondary transfer is started without idling the intermediary transfer belt 5 after a primary transfer. However, when forming a full-color image on a sheet of recording medium which exceeds in length an A4 size sheet, it is necessary to idle the intermediary transfer belt 5 for each primary transfer. Thus, the sequence for a large size sheet illustrated in FIG. 7 is carried out. In the sequence for a large size sheet, the primary transfer for each color is carried out during every second turn of the intermediary transfer belt 5, so that a full-color image can be formed even on a sheet of recording medium which does not satisfy Formula (1). In other words, all that is necessary is to provide an image forming apparatus with a capability to determine whether or not a sheet of recording medium is longer than an A4 sheet prior to the starting of the primary transfer. Therefore, one of the known sheet size detecting means may be employed as the sheet size detecting means for an image forming apparatus in accordance with the present invention. For example, a sheet size detection roller, the movement of which reflects the recording medium size, may be placed in sheet cassette for storing sheets of recording medium, so that the sheet size information is sent to the controlling apparatus 18. The flow chart for the sequence for determining the sheet size is given in FIG. 8.

Further, this embodiment of the present invention is characterized in that the potential level $T_1'$ of the primary transfer bias applied at the first transfer point during the non-transfer period, is made higher than the potential level $T_1$ of the primary transfer bias applied at the first transfer point during the primary transfer of the black toner image, that is, the toner image of the first color, the electrostatic capacity of which is the smallest among the four color toners;

$$T_1 < T_1' \quad (6)$$

More specifically, an arrangement was made so that the potential levels of $T_1$ and $T_1'$ become: $T_1$=+150 (V), whereas, $T_1'$=+250 (V). The research by the inventors of the present invention revealed that when an arrangement was made so that $T_1=T_1'+150$ (V) was satisfied, the so-called reversal transfer phenomenon, the phenomenon that toner transfers back from the surface of an intermediary transfer belt onto the peripheral surface of a photosensitive drum, is liable to occur, but when the level of the transfer bias applied during the idling of the intermediary transfer belt was raised as described above, the reversal transfer phenomenon could be prevented. This is thought to have occurred because such an arrangement increased the force which held fast the toner to the surface of the intermediary transfer belt. More specifically, it is thought that when the toner on the surface of the intermediary transfer belt was passed through the nip, that is, the interface between the intermediary transfer belt and the photosensitive drum, during the period in which the intermediary transfer belt was idled, the potential level of the toner was raised by the electrical charge given to the toner by the electrical discharge which occurred when the intermediary transfer belt and the photosensitive drum separated from each other near the nip (primary transfer nip), and this increase in the potential level of the toner contributed to the prevention of the reversal transfer phenomenon. Regarding the toners other than the black toner, because their electrostatic capacities are inherently high relative to the black toner, the reversal transfer phenomenon is not likely to occur. Thus, the potential level $T_1$ of the primary transfer bias applied at the first transfer point during the transfer process may be made substantially the same as the potential level $T_1'$ of the primary transfer bias applied during the non-transfer period which immediately follows the primary transfer period. However, in order to assure that the reversal transfer phenomenon does not occur, it is desired that, compared to the potential level $T_1$ of the primary transfer bias applied at the first transfer point, the potential level $T_1'$ of the primary transfer bias for the non-transfer period which immediately follows the primary transfer period is set to be higher.

It is also desired that the potential level $T_1'$ of the primary transfer bias for the non-transfer period is set to be smaller than the potential level $T_2$ of the primary transfer bias for transferring (primary transfer) the magenta toner image, that is, the toner image of the second color, from the photosensitive drum 1 to the intermediary transfer belt 5. This is for the following reason. That is, assuming that $T_1>T_2$, as a transfer bias with a potential level of $T_1'$ ($>T_2$) is applied to the transfer roller 8 for primary transfer during the idling of the intermediary transfer belt 5 (non-transfer period) after the primary transfer of the black toner image, that is, the toner image of the first color, an intermediary transfer belt, such as the one in this embodiment, ($10^8$–$10^{14}$ Ω·cm, preferably, $10^{10}$–$10^{14}$ Ω·cm, in volumetric resistivity) is charged up, which affects the primary transfer of the toner image of magenta color, the second color. In other words, a primary transfer bias with the higher potential level $T_2$ becomes necessary, which in turn makes it necessary to correspondingly increase the potential levels $T_3$ and $T_4$ of the transfer biases for the transfer of the toner images of the rest of the colors. Therefore, the capacity of the high voltage power source 9 must be increased so that larger transfer bias can be applied. This leads to cost increase. In addition, if the bias is increased beyond a certain level, electrical discharge occurs adjacent to the nip during primary transfer, which results in an unsatisfactory transfer.

As described, an excellent full-color image, that is, an image which does not suffer from such imperfections as the under saturation of color can be formed on a large piece of recording medium, which does not satisfy Formula (1), by setting the potential level $T_1'$ of the primary transfer bias applied at the primary transfer point during the non-transfer period which follows the transfer period, to be larger than the potential level $T_1$ of the primary transfer bias applied at the primary transfer point during the transfer period.

During the idling of the intermediary transfer belt after the primary transfer of the toner image of the fourth color, the transfer roller 11 for secondary transfer is moved to press the transfer medium against the intermediary transfer belt 5 with a predetermined timing after the trailing edge of the toner image on the intermediary transfer belt 5 passes the secondary transfer point 6*b*. Then, the secondary transfer is started. Similarly, during the idling of intermediary transfer belt after the primary transfer of the toner image of the fourth color, the cleaning roller 13 is placed in contact with the intermediary transfer belt 5 with a predetermined timing after the trailing edge of the toner image on the intermediary transfer belt 5 passes the charging point 13*a*. Then, the charging of the secondary transfer residual toner is started.

Further, after the completion of the primary transfer of the toner image of yellow color, the fourth color, the intermediary transfer belt 5 is idled one full turn to make the potential level of the yellow toner substantially the same as the potential levels of the toners of the first to third colors, which have become high due to the repetition of the primary transfer, so that color aberration or the like does not occur during the secondary transfer. With this arrangement, the secondary transfer process is not carried out while a toner image of yellow color, the fourth color, is transferred (primary transfer) onto the intermediary transfer belt 5 to form a full-color image on a piece of recording medium of a size which does not satisfy Formula (1). Therefore, the potential level of the base layer of the intermediary transfer belt 5 becomes approximately uniform across its entire length, which eliminates a problem peculiar to the structure in accordance to the present invention, that is, increase in apparatus size. Further, such a problem that the shock which occurs the moment the transfer roller 11 for secondary transfer comes in contact with the intermediary transfer belt 5 during a primary transfer period negatively affects the transfer, which results in an image of poor quality, can be prevented.

The image forming apparatus in this embodiment is configured so that the sum of the distance from the exposing point 3*a* to the first transfer point 6*a* along the peripheral surface of the photosensitive drum 1 in terms of the rotational direction of the photosensitive drum 1, and the distance from the first transfer point 6*a* to the second transfer point 6*b* along the peripheral surface of the intermediary transfer belt 5 in terms of the rotational direction of the intermediary transfer belt 5, became smaller than the length of a large piece of recording medium (for example, legal sheet) in terms of the conveyance direction of the medium. In other words, at the very moment when the leading edge of the toner image of the last color (fourth color), which has been transferred onto the intermediary transfer belt 5, passes the second transfer point 6*b*, the photosensitive drum 1 is being exposed to the laser beam 3 to form the trailing end portion of the toner image of the last color on the photosensitive drum 1. Therefore, if the secondary transfer process is started during the seventh rotation of the intermediary transfer belt 5, the primary transfer as well as the latent image formation are negatively affected by the shock which occurs as the transfer roller 11 for secondary transfer comes in contact with the intermediary transfer belt 5.

Figure 9:
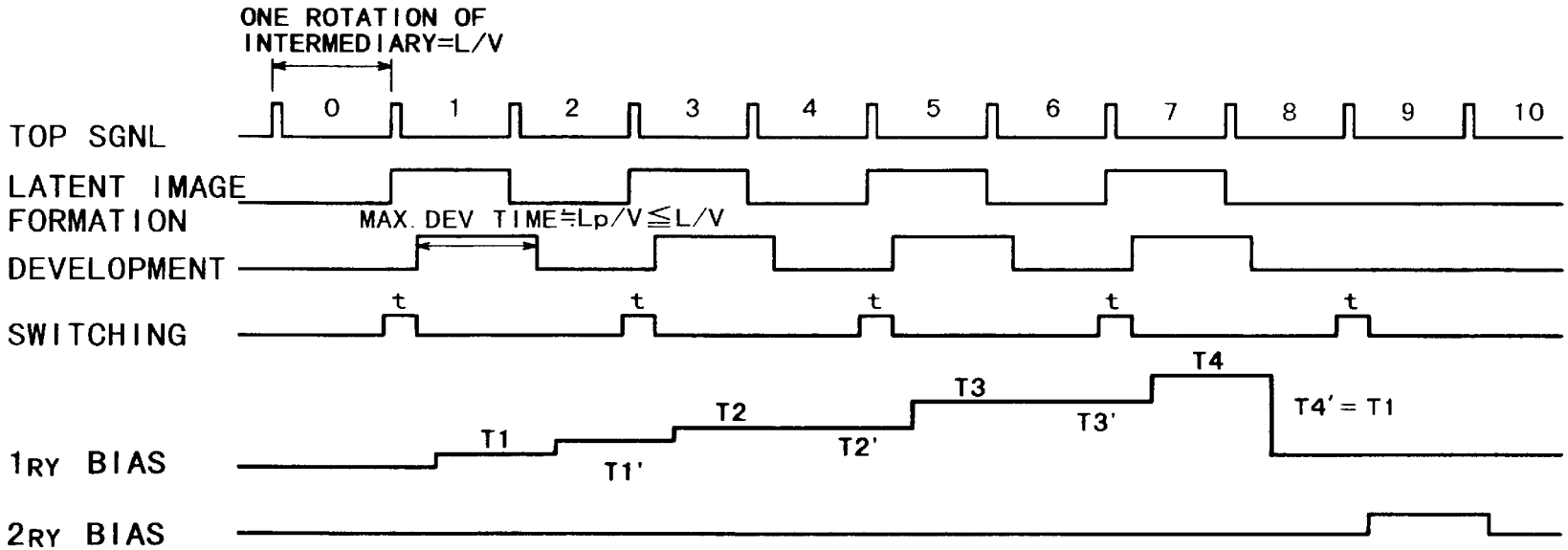
FIG. 9 is a diagram for describing the sequence for a large piece of transfer medium.
Figure 10:
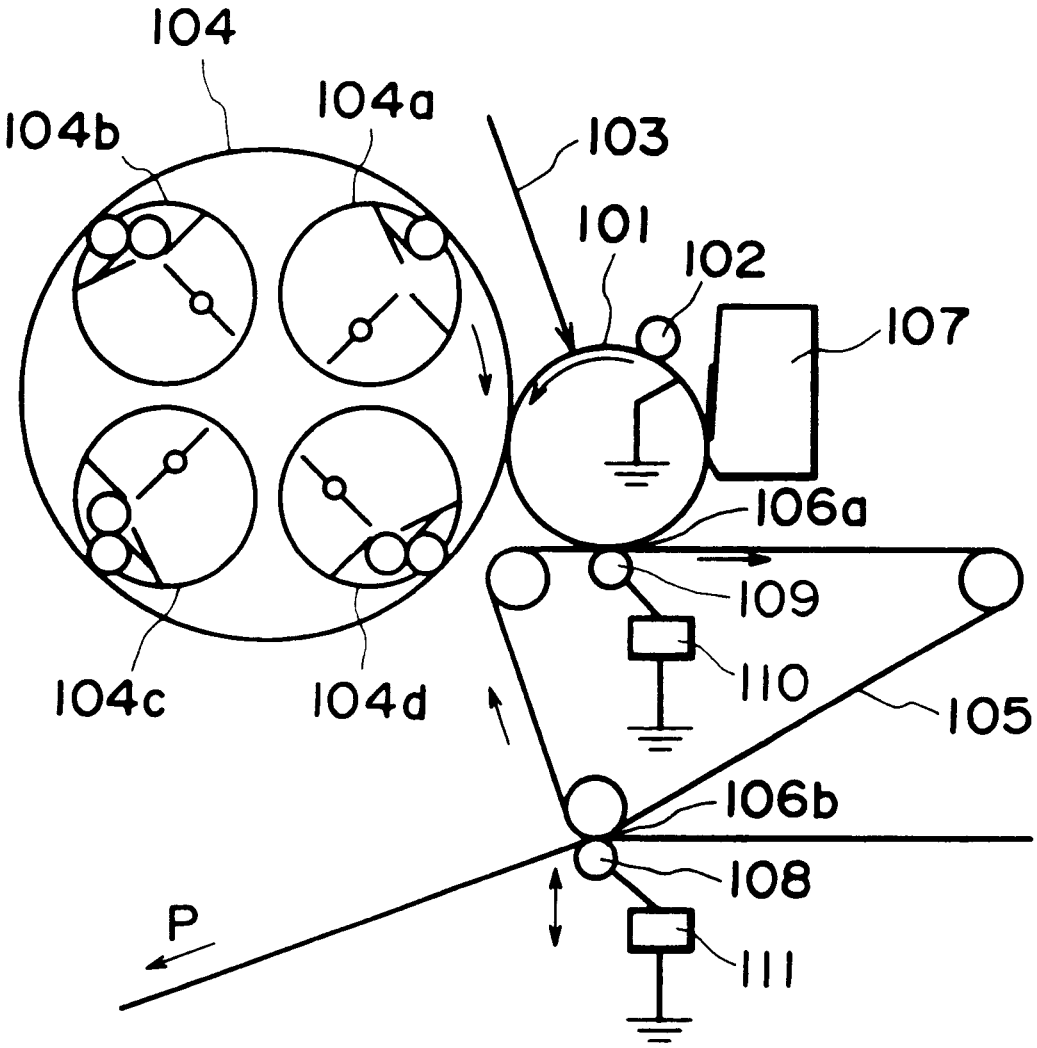
FIG. 10 is a schematic sectional view of a conventional full-color image forming apparatus, and depicts the general structure thereof.

Referring to FIG. 7, the potential levels $T_1'$, $T_2'$, $T_3'$, and $T_4'$ of the biases applied during the non-transfer periods after the secondary transfer of the toner images of the first to fourth colors, correspondingly, were set to be higher than the potential levels $T_1$, $T_2$, $T_3$, and $T_4$ of the biases applied during the primary transfer periods, correspondingly. However, in order to form a full-color image on a large sheet of recording medium which does not satisfy Formula (1), the image formation sequence such as the one presented in FIG. 9 may be carried out. In other words, since the electrostatic capacity of the toner of black color, the first color, is relatively small compared to those of the toners of the second to fourth color toners, the bias potential level $T_1'$ is set to be higher than the potential level $T_1$, whereas since the electrostatic capacities of the other color toners are inherently higher than that of the block toner, the bias potential levels $T_2'$, $T_3'$, and $T_4'$ are set to be substantially the same as the bias potential levels $T_2$, $T_3$, and $T_4$, so that the potential levels of the toners do not become excessively high at the first transfer point 6*a*. Thus, the potential levels of the color toners become proper; they do not become excessively high. As a result, the secondary transfer efficiency is improved while preventing the reversal transfer of the toner particles onto the photosensitive drum.

As described above, a desirable full-color image, that is, an image with no defect, can be formed even on a large sheet of recording medium, which does not satisfy Formula (1), by setting the potential level of the bias applied during the non-transfer process, which immediately follows the primary transfer process, to be larger than, or substantially the same as, the potential level of the bias applied during the primary transfer process, in response to the potential level of the toner (potential level of the toner particles in the developing devices, or the toner particles of the toner image formed on the photosensitive drum), with the use of controlling apparatus 18.

The potential levels $T_1'$ and $T_1$ may be changed in response to humidity.

Further, the voltage level of the primary transfer bias applied during the non-transfer process may be set to be higher than, or substantially the same as, the voltage level of the bias applied during the primary transfer process, in response to the potential level of the toner image formed on the photosensitive drum, measured with the use of a potential level sensor (unillustrated) after the toner image formation, but prior to the primary transfer, and fed back to the controlling apparatus (CPU) 18. With the provision of this arrangement, an image forming apparatus can deal even with the fluctuation of the potential level of the toner which occurs in response to the fluctuation of ambience (humidity).

Further, the potential level $T_4'$ of the primary transfer bias to be applied during the non-transfer rotation of the intermediary transfer belt 5, that is, the idling of the intermediary transfer belt 5 immediately after the transfer of the toner image of the fourth color onto the intermediary transfer belt 5, is set to be substantially the same as the potential level $T_1$ of the primary transfer bias to be applied during the transfer of the toner image of the first color. This is for the following reason. That is, during the secondary transfer process for transferring the toner image onto the surface of the recording medium P from the surface of the intermediary transfer belt 5, which is concurrently carried out along with the idling of the intermediary transfer belt 5 immediately after the primary transfer of the toner image of the fourth color onto the intermediary transfer belt 5, the primary transfer bias with the potential level of $T_4'$, which is the transfer bias for the non-transfer period immediately after the primary transfer of the toner image of the fourth color, is being applied. During this period, the secondary transfer electric field at the second transfer point 6*b* is affected by the potential level of the base layer of the intermediary transfer belt 5 as the counter electrode for the transfer roller 11 for secondary transfer. In addition, while the secondary transfer residual toner on the intermediary transfer belt 5 is charged by the cleaning roller 13 after the secondary transfer, the base layer of the intermediary transfer belt 5 also plays the role of the counter electrode for the cleaning roller 13. In this kind of situation, if the potential level of the base layer of the intermediary transfer belt 5 is high, a secondary transfer bias with a voltage level much higher than the high potential level of the base layer of the intermediary transfer belt 5 must be applied to satisfactorily transfer the toner images onto the intermediary transfer belt 5, and also, a voltage with a much higher potential level than the high potential level of the base intermediary transfer belt 5 must be applied to the cleaning roller 13, which creates problems. For example, the high voltage power sources 12 and 14 must be increased in size, or the image forming apparatus itself must be increased in size so that an intermediary transfer belt with a longer peripheral length can be employed.

In other words, when the length of a piece of recording medium in terms of the recording medium conveyance direction is greater than the distance from the first transfer point 6*a* to the second transfer point 6*b* in terms of the rotational direction of the intermediary transfer belt 5, along the surface of the intermediary transfer belt 5, the above described problems can be prevented by reducing the potential level of the primary transfer bias from the potential level $T_4$ to the potential level $T_4'$ ($=T_1$) during the idling of the intermediary transfer belt 5 immediately after the primary transfer of the toner image of the fourth color.

In this embodiment, in order to prevent the such problems, the potential level $T_4'$ is made smaller than the potential level $T_4$. The timing for the potential level change is after the completion of the primary transfer of the toner image of yellow color, the fourth color, and before the leading edge of the full-color images comprising the four toner images of different color reaches the primary transfer point 6*a*. This arrangement can prevent the potential level of the leading edge side of the toner image from becoming different from the potential level of the trailing side of the toner image.

Further, the potential level $T_4'$ is reduced to substantially the same level as the potential level $T_1$, which is lower than the potential level $T_4$. This is done to transfer (cleaning) the secondary transfer residual toner onto the photosensitive drum 1 from the intermediary transfer belt 5 as soon as the secondary transfer residual toner is charged; in other words, this arrangement adjusts the magnitude of the transfer electric field (cleaning electric field) for transferring (cleaning) the secondary transfer residual toner onto the photosensitive drum 1, to a proper level at which electric discharge or the like phenomenon is not caused at the primary transfer point 6*a* by the transfer electric field.

When forming a plurality of full-color images in succession, at the same time as the black toner image for the following full-color image is transferred (primary transfer) from the photosensitive drum 1 to the intermediary transfer belt 5, the secondary transfer residual toner is transferred from the intermediary transfer belt 5 onto the photosensitive drum 1. During this process, the potential level of the primary transfer bias applied to the transfer roller 8 for primary transfer remains exactly the same as the potential level $T_1$ since the completion of the primary transfer of the toner image of yellow color, the fourth color, for the preceding full-color image. In other words, two transfer processes can be satisfactorily carried out without complicating the controls which must be carried out by the controlling apparatus 18. As a result, the through-put of the image forming apparatus is increased.

In the preceding portions of this specification, the present invention was described with reference to an image formation mode for forming a full-color image. However, the present invention is also applicable to an image formation mode for forming only a monochromatic toner image, for example, a black toner image, on a large piece of recording medium, which does not satisfy Formula (1), in conjunction with the controlling apparatus 18.

It is needless to say that the present invention is applicable to an image formation mode for forming a monochromatic image (for example, black toner image) on just a single sheet of recording medium, as well as continuously forming a monochromatic image on a plural sheets of recording medium.

In such a case, it is desired that the potential level $T_1$ of the primary transfer bias for the black toner image is set to be substantially the same as the potential level $T_1'$ of the primary transfer bias applied during the period (non-transfer period) in which the intermediary transfer belt 5 is idled.

When forming only a single copy, the secondary transfer residual toner is charged to the positive potential by the cleaning roller 13 after the secondary transfer, and then is transferred onto the photosensitive drum 1 at the primary transfer point 6*a*, as described above. Therefore, control is easier when the potential level of the bias applied to the base layer of the intermediary transfer belt 5, which functions as the counter electrode, is kept unchanged.

When continuously forming a full-color image on plural sheets of recording medium, the black toner image for the following full-color image is transferred (primary transfer) onto the intermediary transfer belt 5 at the same time as the secondary transfer residual toner from the preceding full-color image is transferred onto the photosensitive drum 1. Therefore, it is desired that the potential level $T_1$ is set to be the same as the potential level $T_1'$.

In other words, it is desired that whether the potential level $T_1'$ of the bias applied during the non-transfer period is set to be the same as, or larger (smaller than the potential level $T_2$) than the potential level $T_1$, is controlled by the controlling apparatus 18 depending on which of the monochrome and full-color modes is selected.

In the description of the embodiment given above, the present invention was described with reference to an intermediary transfer member in the form of the intermediary transfer belt 5. However, the present invention is also applicable to an intermediary transfer member in the form of a drum, which is constituted of a base member formed of metallic material such as aluminum, and an electrically conductive resin layer coated on the peripheral surface of the base member.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a movable image bearing member for bearing different color toner images;

a movable intermediary transfer member including an electroconductive layer and a surface layer;

first transferring means for applying a voltage to said electroconductive layer to sequentially and superimposedly transfer the different color toner images from said image bearing member onto said intermediary transfer member at a first transfer position;

second transferring means for electrostatically transferring the different color toner images from said intermediary transfer member on the transfer material at a second transfer position, wherein said second transferring means is disposed faced to such a side of said intermediary transfer member as receives the toner image;

wherein said image forming apparatus is operable with the transfer material having a length measured in a direction of feeding of the transfer material, which is longer than a distance between the first transfer position to the second transfer position in a moving direction of said intermediary transfer member;

wherein when a toner image is formed on the transfer material having a length in the transfer material feeding direction longer than said distance, the different color toner images on said intermediary transfer member pass through the first transfer position in a period which is after completion of transfer of the different color toner image from said image bearing member onto said intermediary transfer member by said first transferring means and before transfer of the different color toner images from said intermediary transfer member onto the transfer material by said second transferring means;

control means for switching a voltage applied to said electroconductive layer by said first transferring means from a first voltage for transferring a final color toner image from said image bearing member onto said intermediary transfer member to a second voltage having a smaller absolute value than that of the first voltage before a leading edge of the different color toner images on said intermediary transfer member reaches the first transfer position;

wherein said second transferring means starts transfer of the toner image from said intermediary transfer member onto the transfer material after said control means switches the voltage to the second voltage.

2. An apparatus according to claim 1, wherein said control means is operative to select either a first mode for transferring the different color toner images from said intermediary transfer member onto the transfer material by said second transferring means or a second mode in which the different color toner images on said intermediary transfer member pass through the first transfer position during the period, after completion of transfer of the different color toner images from said image bearing member onto said intermediary transfer member by said first transferring means and before passage of the toner image on the intermediary transfer member through the first transfer position.

3. An apparatus according to claim 2, wherein said control means selects the mode in accordance with a length of a transfer material measured in a direction of feeding thereof.

4. An apparatus according to claim 3, wherein further comprising detecting means for detecting a length of the transfer material in a direction of feeding thereof, wherein said control means selects the mode in accordance with an output of said detecting means.

5. An apparatus according to claim 3 or 4, wherein when the length of the transfer material is shorter than a predetermined length, said control means selects the first mode.

6. An apparatus according to claim 3 or 4, wherein when the length of the transfer material is longer than a predetermined length, said control means selects the second mode.

7. An apparatus according to claim 6, further comprising latent image forming means for forming a latent image by exposing said image bearing member to light at an exposure position, wherein a length of the transfer material in a feeding direction thereof is longer than a sum of a distance from the exposure position to the first transfer position measured in a moving direction of said image bearing member and a distance from the first transfer position to the second transfer position measured in a moving direction of said intermediary transfer member.

8. An apparatus according to claim 7, wherein said second transferring means includes a roller which is movable between a first position in which said roller is urged to said intermediary transfer member to transfer the different color toner images on said intermediary transfer member and a second position in which said roller is away from said intermediary transfer member.

9. An apparatus according to claim 8, wherein said second transferring means moves to the first position after a trailing edge of the different color toner images on said intermediary transfer member pass through the second transfer position in said period.

10. An apparatus according to claim 8, wherein said image bearing member is contacted to said intermediary transfer member at the first transfer position during transfer of the toner image from said image bearing member onto said intermediary transfer member.

11. An apparatus according to any one of claims 2–4, wherein said control means is operable to select either a third mode in which only the monochromatic toner image is transferred from said image bearing member onto said intermediary transfer member by said first transferring means, and the monochromatic toner image is transferred from said intermediary transfer member on the transfer material by said second transferring means, or a fourth mode in which said different color toner images are sequentially and superimposedly transferred from said image bearing member onto said intermediary transfer member by said first transferring means, and the different color toner images are transferred from said intermediary transfer member onto the transfer material by said second transferring means.

12. An apparatus according to claim 11, wherein when the second mode and the third mode are selected, the third voltage applied to said intermediary transfer member by said first transferring means when the monochromatic toner image on said intermediary transfer member passes through the first transfer position during said period, is substantially the same as the voltage applied to said intermediary transfer member by said first transferring means to transfer the monochromatic toner image from said image bearing member onto said intermediary transfer member.

13. An apparatus according to claim 12, further comprising charging means for charging at a charging position residual toner remaining on said intermediary transfer member after transfer of the monochromatic toner image from said intermediary transfer member on the transfer material by said second transferring means to a polarity opposite from a regular charge polarity of the toner.

14. An apparatus according to claim 13, wherein an electric field effective to electrostatically transfer the residual toner charged by said charging means from said intermediary transfer member back onto said intermediary transfer member is formed by said first transferring means at the first transfer position.

15. An apparatus according to claim 13, wherein said first transferring means forms at the first transfer position an electric field effective to electrostatically transfer the residual toner from said intermediary transfer member back onto said image bearing member and to simultaneously and electrostatically transfer the monochromatic toner image from said image bearing member onto said intermediary transfer member.

16. An apparatus according to claim 15, wherein said electric field is formed by application of the second voltage to said intermediary transfer member by said first transferring means.

17. An apparatus according to claim 13, wherein said charging means is movable toward and away from said intermediary transfer member, and is contacted to said intermediary transfer member after a trailing edge of the monochromatic toner image on said intermediary transfer member passes through the charging position during said period.

18. An apparatus according to claim 11, wherein the monochromatic toner image is a black toner image.

19. An apparatus according to claim 1, further comprising charging means for charging residual toner remaining on said intermediary transfer member after transfer of the different color toner images from said intermediary transfer member onto the transfer material by said second transferring means, to a polarity opposite from a regular charge polarity of the toner at a charging position.

20. An apparatus according to claim 19, wherein an electric field effective to electrostatically transfer the residual toner charged by said charging means from said intermediary transfer member back onto said intermediary transfer member is formed by said first transferring means at the first transfer position.

21. An apparatus according to claim 1, wherein said first transferring means forms an electric field, at the first transfer position, effective to electrostatically transfer a next first color toner image from said image bearing member onto said intermediary transfer member and simultaneously to transfer the residual toner charged by the charging means from said intermediary transfer member onto said image bearing member.

22. An apparatus according to claim 21, wherein said electric field is formed by application of the second voltage to said intermediary transfer member by said first transferring means.

23. An apparatus according to any one of claims 22, wherein said charging means is movable toward and away from said intermediary transfer member, and said charging means contacts said intermediary transfer member after passage of a trailing edge of the final color toner image on said intermediary transfer member through the charging position during said period.

24. An apparatus according to claim 1, wherein the second voltage is substantially the same as a voltage applied to said intermediary transfer member by said first transferring means when a first color toner image is transferred from said image bearing member onto said intermediary transfer member.

25. An apparatus according to claim 1, wherein potentials of said electroconductive layer at said first transfer position and said second transfer position, are substantially the same with each other.

26. An apparatus according to claim 25, wherein the voltage applied to said intermediary transfer member by said first transferring means is maintained during transfer of the different color toner images from said intermediary transfer member onto the transfer material by said second transferring means.

27. An apparatus according to claim 1, wherein said surface layer has a volume resistivity of $10^8$–$10^{14}$ Ωcm.

28. An apparatus according to claim 27, wherein said surface layer has a volume resistivity of $10^{10}$–$10^{14}$ Ωcm.

29. An apparatus according to claim 1, wherein said first transferring means is provided with a voltage source for applying a voltage to said intermediary transfer member.

30. An apparatus according to claim 29, wherein said first transferring means includes a roller contacting to said electroconductive layer when the toner image is transferred from said image bearing member onto said intermediary transfer member, and the voltage is applied to said intermediary transfer member through said roller.

31. An image forming apparatus comprising:

a movable image bearing member for carrying the toner image;

a movable intermediary transfer member including an electroconductive layer and a surface layer;

first transferring means for applying a voltage to said electroconductive layer to sequentially and superimposedly transfer the toner images from said image bearing member onto said intermediary transfer member at a first transfer position;

second transferring means for electrostatically transferring the tone images from said intermediary transfer member on the transfer material at a second transfer position, wherein said second transferring means is disposed faced to such a side of said intermediary transfer member as receives the tone image;

wherein said image forming apparatus is operable with the transfer material having a length measured in a direction of feeding of the transfer material, which is longer than a distance between the first transfer position to the second transfer position in a moving direction of said intermediary transfer member;

wherein when a toner image is formed on the transfer material having a length in the transfer material feeding direction longer than said distance, the different color toner images on said intermediary transfer member pass through the first transfer position in a period which is after completion of transfer of the toner image from said image bearing member onto said intermediary transfer member by said first transferring means and before transfer of the toner image from said intermediary transfer member onto the transfer material by said second transferring means;

control means for switching a voltage applied to said electroconductive layer by said first transferring means from a first voltage for transferring a final color toner image from said image bearing member onto said intermediary transfer member to a second voltage having a smaller absolute value than that of the first voltage before a leading edge of the toner image on said intermediary transfer member reaches the first transfer position;

wherein said second transferring means starts transfer of the toner image from said intermediary transfer member onto the transfer material after said control means switches the voltage to the second voltage.

32. An apparatus according to claim 31, wherein said control means is operative to select either a first mode for transferring the toner image from said intermediary transfer member onto the transfer material by said second transferring means or a second mode in which the toner image on said intermediary transfer member pass through the first transfer position during the period, after completion of transfer of the toner image from said image bearing member onto said intermediary transfer member by said first transferring means and before passage of the toner image on the intermediary transfer member through the first transfer position.

33. An apparatus according to claim 32, wherein said control means selects the mode in accordance with a length of a transfer material measured in a direction of feeding thereof.

34. An apparatus according to claim 33, wherein further comprising detecting means for detecting a length of the transfer material in a direction of feeding thereof, wherein said control means selects the mode in accordance with an output of said detecting means.

35. An apparatus according to claim 33 or 34, wherein when the length of the transfer material is shorter than a predetermined length, said control means selects the first mode.

36. An apparatus according to claim 33 or 34, wherein when the length of the transfer material is longer than a predetermined length, said control means selects the second mode.

37. An apparatus according to claim 31, further comprising charging means for charging residual toner remaining on said intermediary transfer member after transfer of the toner image from said intermediary transfer member onto the transfer material by said second transferring means, to a polarity opposite from a regular charge polarity of the toner at a charging position.

38. An apparatus according to claim 37, wherein an electric field effective to electrostatically transfer the residual toner charged by said charging means from said intermediary transfer member back onto said intermediary transfer member is formed by said first transferring means at the first transfer position.

39. An apparatus according to claim 38, wherein said electric field is formed by application of the second voltage to said intermediary transfer member by said first transferring means.

40. An apparatus according to claim 31, wherein potentials of said electroconductive layer at said first transfer position and said second transfer position, are substantially the same with each other.

41. An apparatus according to claim 40, wherein the voltage applied to said intermediary transfer member by said first transferring means is maintained during transfer of the toner image from said intermediary transfer member onto the transfer material by said second transferring means.

42. An apparatus according to claim 31, wherein said surface layer has a volume resistivity of $10^8$–$10^{14}$ Ωcm.

43. An apparatus according to claim 40, wherein said surface layer has a volume resistivity of $10^8$–$10^{14}$ Ωcm.

44. An apparatus according to claim 31, wherein said first transferring means is provided with a voltage source for applying a voltage to said intermediary transfer member.

45. An apparatus according to claim 44, wherein said first transferring means includes a roller contacting to said electroconductive layer when the toner image is transferred from said image bearing member onto said intermediary transfer member, and the voltage is applied to said intermediary transfer member through said roller.

* * * * *

UNITED STATES PATENT AND TRADEMARK OFFICE

CERTIFICATE OF CORRECTION

PATENT NO. : 6,125,247 
APPLICATION NO. : 09/334561
DATED : September 26, 2000
INVENTOR(S) : Shinichi Tsukida et al.

It is certified that error appears in the above-identified patent and that said Letters Patent is hereby corrected as shown below:

CLAIMS 1-4, 7, 10-14, 20, 21, 23, 25, 31-34, 38 AND 40 SHOULD BE DELETED AND SUBSTITUTED WITH THE FOLLOWING CLAIMS 1-4, 7, 10-14, 20, 21, 23, 25, 31-34, 38 AND 40:

--1. An image forming apparatus comprising:

a moving image bearing member for bearing different color toner images;

a movable intermediary transfer member including an electroconductive layer and a surface layer;

first transferring means for applying a voltage to said electroconductive layer to sequentially and superimposedly transfer the different color toner images from said image bearing member onto said intermediary transfer member at a first transfer position;

second transferring means for electrostatically transferring the different color toner images from said intermediary transfer member onto a transfer material at a second transfer position, wherein said second transferring means is disposed so as to face a side of said intermediary transfer member that receives the different color toner image;

wherein said image forming apparatus is operable with the transfer material having a length measured in a transfer material feeding direction, which is longer than a distance between the first transfer position and the second transfer position in a moving direction around the periphery of said intermediary transfer member;

wherein when the different color toner images are formed on the transfer material having said length longer than said distance, the different color toner images on said intermediary transfer member pass through the first transfer position in a period which is after completion of transfer of the different color toner images from said image bearing member onto said intermediary transfer member by said first transferring means and before transfer of the different color toner images from said intermediary transfer member onto the transfer material by said second transferring means;

control means for switching a voltage applied to said electroconductive layer by said first transferring means from a first voltage for transferring a final color toner image from said image bearing member onto said intermediary transfer member to a second voltage having a smaller absolute value than that of the first voltage before a leading edge of the different color toner images on said intermediary transfer member reaches the first transfer position;

wherein said second transferring means starts transfer of the different color toner images from said intermediary transfer member onto the transfer material after said control means switches the voltage to the second voltage.

2. An apparatus according to claim 1, wherein said control means is operative to It is certified that error appears in the above-identified patent and that said Letters Patent is hereby corrected as shown below:

select either a first mode for transferring the different color toner images from said intermediary transfer member onto the transfer material by said second transferring means or a second mode in which the diferent color toner images on said intermediary transfer member pass through the first transfer position during the period.

3. An apparatus according to claim 2, wherein said control means selects either the first mode or the second mode in accordance with the length of the transfer material.

4. An apparatus according to claim 3, further comprising detecting means for detecting the length of the transfer material, wherein said control means selects either the first mode or the second mode in accordance with an output of said detecting means.

7. An apparatus according to claim 6, further comprising latent image forming means for forming a latent image by exposing said image bearing member to light at an exposure position, wherein the length of the transfer material is longer than a sum of a distance from the exposure position to the first transfer position measured in a moving direction around the periphery of said image bearing member and a distance from the first transfer position to the second transfer position measured in a moving direction around the periphery of said intermediary transfer member.

10. An apparatus according to claim 8, wherein said image bearing member is contacted to said intermediary transfer member at the first transfer position during transfer of the different color toner images from said image bearing member onto said intermediary transfer member.

11. An apparatus according to any one of claims 2-4, wherein said control means is operable to select either a third mode in which only the monochromatic toner image is transferred from said image bearing member onto said intermediary transfer member by said first transferring means, and the monochromatic toner image is transferred from said intermediary transfer member onto the transfer material by said second transferring means, or a fourth mode in which said different color toner images are sequentially and superimposedly transferred from said image bearing member onto said intermediary transfer member by said first transferring means, and the different color toner images are transferred from said intermediary transfer member onto the transfer material by said second transferring means

UNITED STATES PATENT AND TRADEMARK OFFICE

CERTIFICATE OF CORRECTION

PATENT NO. : 6,125,247
APPLICATION NO. : 09/334561
DATED : September 26, 2000
INVENTOR(S) : Shinichi Tsukida et al.

It is certified that error appears in the above-identified patent and that said Letters Patent is hereby corrected as shown below:

12. An apparatus according to claim 11, wherein when the second mode and the third mode are selected, a third voltage applied to said intermediary transfer member by said first transferring means when the monochromatic toner image on said intermediary transfer member passes through the first transfer position during said period, is substantially the same as a voltage applied to said intermediary transfer member by said first transferring means to transfer the monochromatic toner image from said image bearing member onto said intermediary transfer member.

13. An apparatus according to claim 12, further comprising charging means for charging at a charging position residual toner remaining on said intermediary transfer member after transfer of the monochromatic toner image from said intermediary transfer member onto the transfer material by said second transferring means to a polarity opposite from a regular charge polarity of the toner.

14. An apparatus according to claim 13, wherein an electric field effective to electrostatically transfer the residual toner charged by said charging means from said intermediary transfer member back onto said image bearing member is forming by said first transferring means at the first transfer position.

20. An apparatus acording to claim 19, wherein an electric field effective to electrostatically transfer the residual toner charged by said charging means from said intermediary transfer member back onto said image bearing member is formed by said first transferring means at the first transfer position.

21. An apparatus according to claim 19, wherein said first transferring means forms an electric field, at the first transfer position, effective to electrostatically transfer the different color toner images from said image bearing member onto said intermediary transfer member and simultaneously to transfer the residual toner charged by the charging means from said intermediary transfer member onto said image bearing member.

23. An apparatus according to any one of claims 19 to 22, wherein said charging means is movable toward and away from said intermediary transfer member, and said charging means contacts said intermediary transfer member after passage of a trailing edge of the final color toner image on said intermediary transfer member through the charging position during said period.

25. An apparatus according to claim 1, wherein potentials of said electroconductive layer at said first transfer position and said second transfer position are substantially the same.

UNITED STATES PATENT AND TRADEMARK OFFICE

CERTIFICATE OF CORRECTION

PATENT NO. : 6,125,247
APPLICATION NO. : 09/334561
DATED : September 26, 2000
INVENTOR(S) : Shinichi Tsukida et al.

It is certified that error appears in the above-identified patent and that said Letters Patent is hereby corrected as shown below:

31. An image forming apparatus comprising:
a movable image bearing member for carrying a toner image;
a movable intermediary transfer member including an electroconductive layer and a surface layer;

32. An apparatus according to claim 31, wherein said control means is operative to select either a first mode for transferring the toner image from said intermediary transfer member onto the transfer material by said second transferring means for a second mode in which the toner image on said intermediary transfer member passes through the first transfer position during the period.

33. An apparatus according to claim 32, wherein said control means selects either the first mode or the second mode in accordance with the length of the transfer material.

34. An apparatus according to claim 33, further comprising detecting means for detecting the length of the transfer material, wherein said control means selects either the first or the second mode in accordance with an output of said detecting means.

38. An apparatus according to claim 37, wherein an electric field effective to electrostatically transfer the residual toner charged by said charging means from said intermediary transfer member back onto said image bearing member is formed by said first transferring means at the first transfer position.

UNITED STATES PATENT AND TRADEMARK OFFICE

CERTIFICATE OF CORRECTION

PATENT NO. : 6,125,247
APPLICATION NO. : 09/334561
DATED : September 26, 2000
INVENTOR(S) : Shinichi Tsukida et al.

It is certified that error appears in the above-identified patent and that said Letters Patent is hereby corrected as shown below:

40. An apparatus according to claim 31, wherein potentials of said electroconductive layer at said first transfer position and said second transfer position are substantially the same.--

Signed and Sealed this

Twenty-sixth Day of September, 2006

JON W. DUDAS
*Director of the United States Patent and Trademark Office*